US006565233B1

(12) United States Patent
Richardson

(10) Patent No.: US 6,565,233 B1
(45) Date of Patent: May 20, 2003

(54) COLOR, SIZE AND DISTRIBUTION MODULE FOR PROJECTED LIGHT

(76) Inventor: Brian Edward Richardson, 18675-K Adams Ct., Morgan-Hill, CA (US) 95037

( * ) Notice: Subject to any disclaimer, the term of this patent is extended or adjusted under 35 U.S.C. 154(b) by 0 days.

(21) Appl. No.: 09/376,262

(22) Filed: Aug. 17, 1999

(51) Int. Cl.[7] ..... F21V 9/00

(52) U.S. Cl. ..... 362/293; 362/355; 362/246; 362/329; 362/336

(58) Field of Search ..... 362/355, 246, 362/293, 2, 328, 329, 336, 337; 359/615, 885–892

(56) References Cited

U.S. PATENT DOCUMENTS 4,037,097 A * 7/1977 Stillman et al. ..... 362/433
4,602,321 A * 7/1986 Bornhorst ..... 362/268
4,796,171 A * 1/1989 Lindae et al. ..... 362/308
4,882,617 A * 11/1989 Vriens ..... 362/293
5,842,765 A * 12/1998 Cassarly et al. ..... 362/32
5,969,868 A * 10/1999 Bornhorst et al. ..... 359/589
6,048,081 A * 4/2000 Richardson ..... 362/307
6,062,710 A * 5/2000 Hewitt ..... 362/351
6,079,854 A * 6/2000 Ra ..... 362/342
6,099,146 A * 8/2000 Imamura et al. ..... 362/29
6,101,034 A * 8/2000 Cox et al. ..... 359/562
6,102,554 A * 8/2000 Wilson et al. ..... 362/281
6,102,556 A * 8/2000 Lieberman et al. ..... 362/433
6,142,652 A * 11/2000 Richardson ..... 362/280
6,152,577 A * 11/2000 Rizkin et al. ..... 362/281
6,231,200 B1 * 5/2001 Shinohara et al. ..... 362/31

* cited by examiner

*Primary Examiner*—Sandra O'Shea
*Assistant Examiner*—Anabel Ton
(74) *Attorney, Agent, or Firm*—The Kline Law Firm

(57) ABSTRACT

A lighting module that projects various colors, hues and intensities of light, and that can change the divergence and distribution of light. The device includes a light source and a reflector to direct the light along an optic path in a generally parallel direction. The invention does not provide a beam that is parallel or even somewhat parallel. It is intended for applications in which a somewhat diffused beam is required. In addition to the light source, the module comprises a filter assembly with at least one filter therein, and a system diffusion optical element. The filter assembly controls the size and color of the light beam. The system diffusion optical element spreads the light in one or more desired directions so that fewer modules are required to light a given area.

15 Claims, 11 Drawing Sheets

COLOR, SIZE AND DISTRIBUTION MODULE FOR PROJECTED LIGHT

FIELD OF THE INVENTION

This invention relates generally to entertainment and architectural lighting, and more specifically is a device to control the hue, saturation, and brightness of color emanating from a lighting module. The device also allows a user to control beam size and the distribution of light.

BACKGROUND OF THE INVENTION

Colored light sources are often used in the theater, television, touring productions, and architectural applications. The color is varied in hue, saturation, beam size, and/or distribution to obtain a particular artistic effect. The artistic requirements might be that the color, size and or distribution remain static, or that those attributes change over time. Cost, speed of changing, the quantity of colors produced, the smoothness of color changing, compact size and weight, and the efficiency of transmitting light through color filters are all factors in the practical usage of a color changing system. A smooth distribution is desired for the light and color when the light beam is projected onto a surface that is perpendicular and off axis. Off axis projection is common when the walls of a building are being illuminated.

One prior art method of changing the color of a light source is to manually insert a specific color filter in the light's path to obtain a specific artistic result. This method required that the filter be changed if it did not result in the exact color that was desired. Changing a color filter required the procurement of the new color filter and the replacement of the old filter. This use of specific filters makes it impractical to change the color of the light during a performance. The filters most often used in these applications are dyed or coated plastic films called gel. The durability of this material is limited and requires frequent replacement when used with a high powered light source. The general efficiency of light transmission is low. In the creation of certain dark blue and red colors, transmission can be as low as 2%.

Since the introduction of the use of gel as a color filter, inventors have created several methods to remotely change the color of a light source utilizing gel. The Scroller™, by Wybron of Colorado Springs, Colo., assembles a plurality of different colored gels into a band that is fitted around a pair of scrolls. The scrolls are spaced on opposite sides of the light source's aperture. By rolling the scrolls, any of the colors on them can be accessed. This method and its variations, embodied in products manufactured by a number of companies, is a compact solution to changing color. However, the method has many deficiencies. The mechanism to locate and control the scrolls is costly and complex. Gel deteriorates in a short time when rolled back and forth on a scroll while being subjected to heat from a light source. Furthermore, the number of different colors that can be used at one time is limited to the number of colors that can be assembled into a single gel band. The slow speed of color changing, the low transmission efficiency of the filter material, and the need to frequently replace gel filter material are also deficiencies in this prior art method. This invention includes no method to change beam size or distribution.

U.S. Pat. No. 5,126,886, to the present inventor Richardson, discloses an improved scroll type gel color changer. Yellow, cyan, and magenta scrolls of varying color saturation are located in series in the optic path. The various position locations of the three scrolls result in an unlimited number of colors. Colors can be changed quickly or slowly. The transition from one color to another is smooth. The mechanism of this color changing system has three times the complexity of the single scroll system and therefore suffers in cost and reliability. This invention includes no method to change beam size in or distribution.

Other inventors have created several other methods to change the color of a light source utilizing interference or dichroic type filters. Dichroic filters are efficient in transmitting light and are durable, but they are costly. U.S. Pat. No. 5,073,847, to Bornhorst, issued Dec. 17, 1991, and U.S. Pat. No. 5,186,536, to Bornhorst, et al., issued Feb. 16, 1993, disclose a method of tilting a series of dichroic color filters to create various colors. However, this system is limited in the quantity of colors that it creates, the excessive cost of the color filters, and the fact that the system requires a very complex control mechanism.

U.S. Pat. No. 4,914,556, to the present inventor Richardson, issued Jun. 30, 1992, discloses an assembly of yellow, cyan, and magenta filter wheels, each with varying levels of color saturation. The positioning of the wheels between a light source and an aperture determines saturation and hue of color at the aperture. This module creates an unlimited quantity of colors, however at a relatively high cost. The filters of this module must be many times greater in size than the aperture. This results in a very high cost to aperture size ratio.

In the past, the divergence and distribution of a light source was changed by manually replacing the light source type to obtain a specific artistic result. Utilizing a different reflector configuration could also change it. The use of a specific lamp for each type of divergence sought makes it impractical to change the divergence of the light source during a performance. Therefore, more overall lighting fixtures are required to accomplish the desired artistic results.

U.S. Pat. No. 4,973,306, issued Nov. 20, 1990, to Bornhorst, discloses a series of diffusion panels that are introduced from the sides of a beam of light. This creates various beam divergences. However, this fails to create a range of beams with a smooth field of illumination. Further, this system comprises a complex mechanism that is costly and unreliable. It also provides no method to change beam distribution.

U.S. Pat. No. 5,073,847, also to Bornhorst, discloses another diffusion mechanism. A series of rotatable diffusion panels are arranged in a radial array. Rotation of the panels into the light path diffuses the light beam. This mechanism also proves to be expensive and provides no method to change the beam distribution. There is also an insufficient range of beam sizes to provide a smooth transition from narrow to full diffusion. To control the beam size the lens requires that it be changed.

U.S. Pat. No. 5,665,305, issued Sep. 9, 1997, to Belliveau, et al., discloses a method of intervening one or two lenticular panels to change beam divergence and or beam shape. These panels are oriented so as to be orthogonal to one another when engaged. This method does not allow for continuous changes in beam size or shape.

Accordingly, it is an object of the present invention to provide a device that, given a white light source, can emit any color chosen by a user. The device can also change from one color to any other color quickly and smoothly.

It is another object of the present invention to provide a light beam divergence and distribution module that is compact, and that is inexpensive to produce and to maintain. The module is of simple construction, and is therefore very reliable.

It is a still further object of the present invention to provide a device that efficiently transmits light.

SUMMARY OF THE INVENTION

The present invention is a lighting module that projects various colors, hues and intensities of light. Further, the module can change the divergence and distribution of light. The device includes a light source and a reflector to direct the light along an optic path in a generally parallel direction. The invention does not provide a beam that is parallel or even somewhat parallel. It is intended for applications in which a somewhat diffused beam is required, or in which the beam is to be diffused in at least one direction.

In addition to the light source, the module comprises a filter assembly with at least one filter therein, and a size diffusion filter. The filter assembly controls the size and color of the light beam. A system diffusion filter spreads the light in one or more desired directions so that fewer modules are required to light a given area.

An advantage of the present invention is that it provides a single, compact unit that allows the user to project any color, hue, size distribution, or intensity of light desired. This eliminates the need for multiple pieces of equipment.

Another advantage of the present invention is that it is simple and inexpensive to manufacture and is therefore reliable and easy to maintain.

These and other objectives and advantages of the present invention will become apparent to those skilled in the art, in view of the description of the best presently known mode of carrying out the invention as described herein and as illustrated in the drawings.

DETAILED DESCRIPTION OF THE INVENTION

Figure 1:
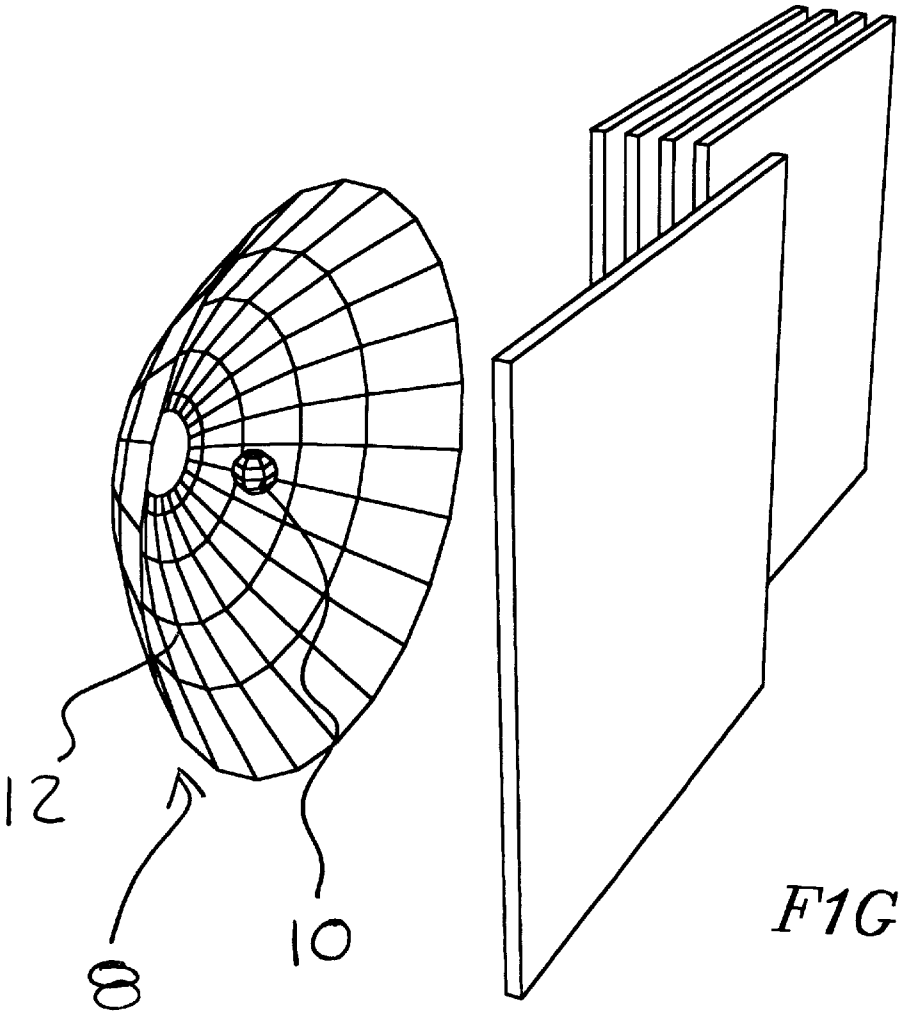
FIG. 1 shows a perspective view of the color, size and distribution module with an accompanying light source.
Figure 2:
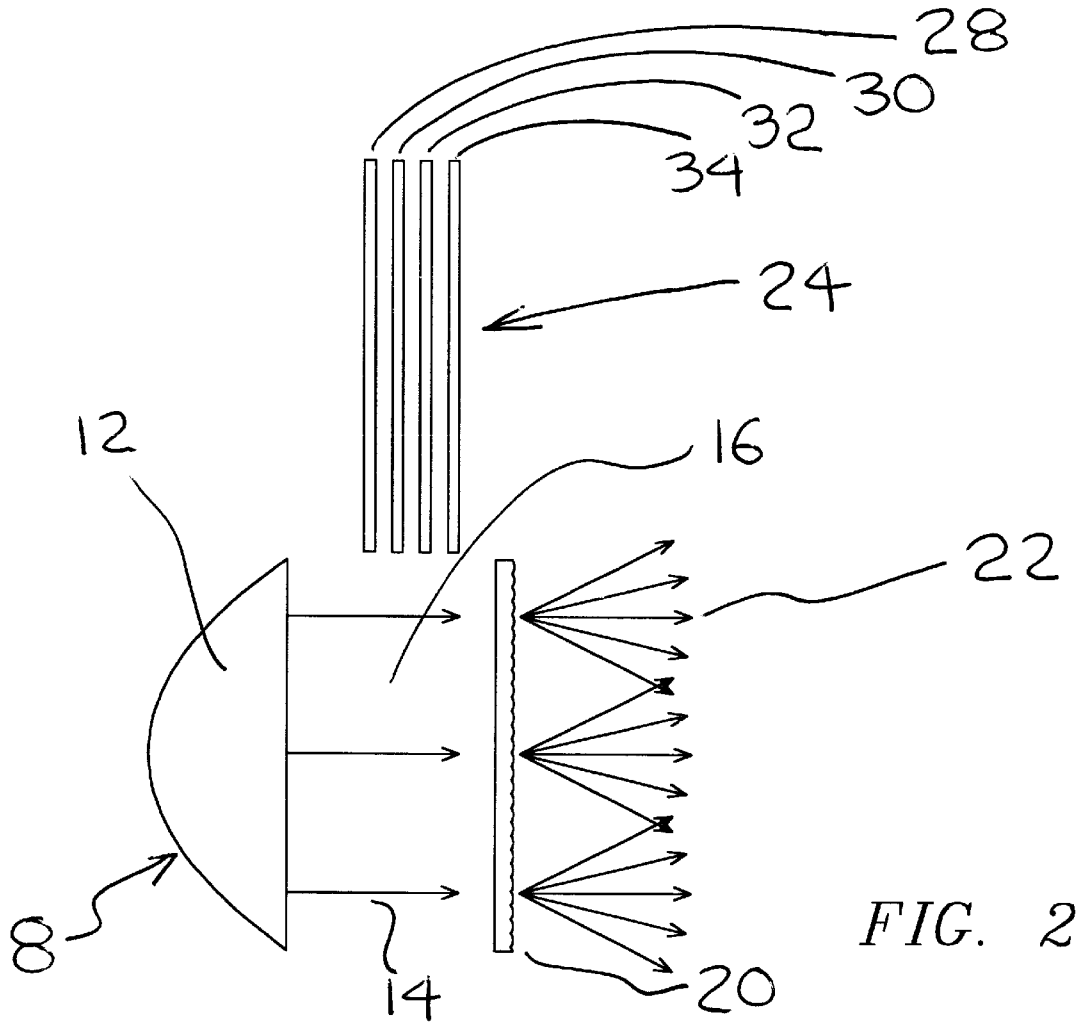
FIG. 2 is a top view of the module.

Referring first to FIGS. 1 and 2, the present invention is a color filter, size, and distribution module that includes a light source. A parallel light source 8 is shown for reference in describing the operation of the system. The parallel light source 8 may be chosen from many types and sizes. The parallel light source 8 includes a light source (lamp) 10 that is located within a reflector 12. The reflector 12 and the light source 10 may be of any common type or size. The lamp 10 may be incandescent or arc type. A parabolic reflector 12 is depicted in the drawings. Any parallel light source that generates generally parallel light, such as a light source with a condenser lens, can also be used in the module. The various type of parallel light sources are well known to those skilled in the art.

Referring now chiefly to FIG. 2, inbound light rays 14 emanate from the parallel light source 8 and take substantially parallel paths along an optical path that includes an interchangeable filter region 16. The light rays continue on through a system diffusion optical element 20, and exit a system diffusion optical element 20 as projected outbound light rays 22.

An optic filter assembly 24 comprising a plurality of filter elements is located adjacent to the interchangeable filter area 16. The optic filter assembly 24 will generally comprise at least a cyan filter 28, a magenta filter 30, a yellow filter 32, and a size diffusion filter 34. The ordering of the optic filters 28, 30, 32, and 34 makes no difference to the operation of the device. Further, the filter material can be of any type of dichroic, pigmented glass, pigmented plastic, or any other type of light filter. The size diffusion filter 34 can be of any known type and may be constructed from glass or plastic. The module is shown as being constructed so that the filter assembly 24 is introduced into the light beam from a single side. It should be understood that the individual filters could be introduced into the light beam from any desired number of directions. A further distinction of the system of the present invention is that the filters need be introduce into only a portion of the light beam to yield a uniformly modified projected beam. This phenomenon is due to the characteristics of the system diffusion element 20, and is discussed in detail below with reference to FIG. 11.

If the user has an application requiring the generation of only one specific color, a single filter may be employed rather than the filter assembly 24 as disclosed. Other filter types may be employed in the filter assembly 24 as well. Examples of other types of light filters that may be employed are: red, green, and blue filters; ultraviolet transmitting filters; polarizing filters; dimming filters; and color correction filters.

Figure 3:
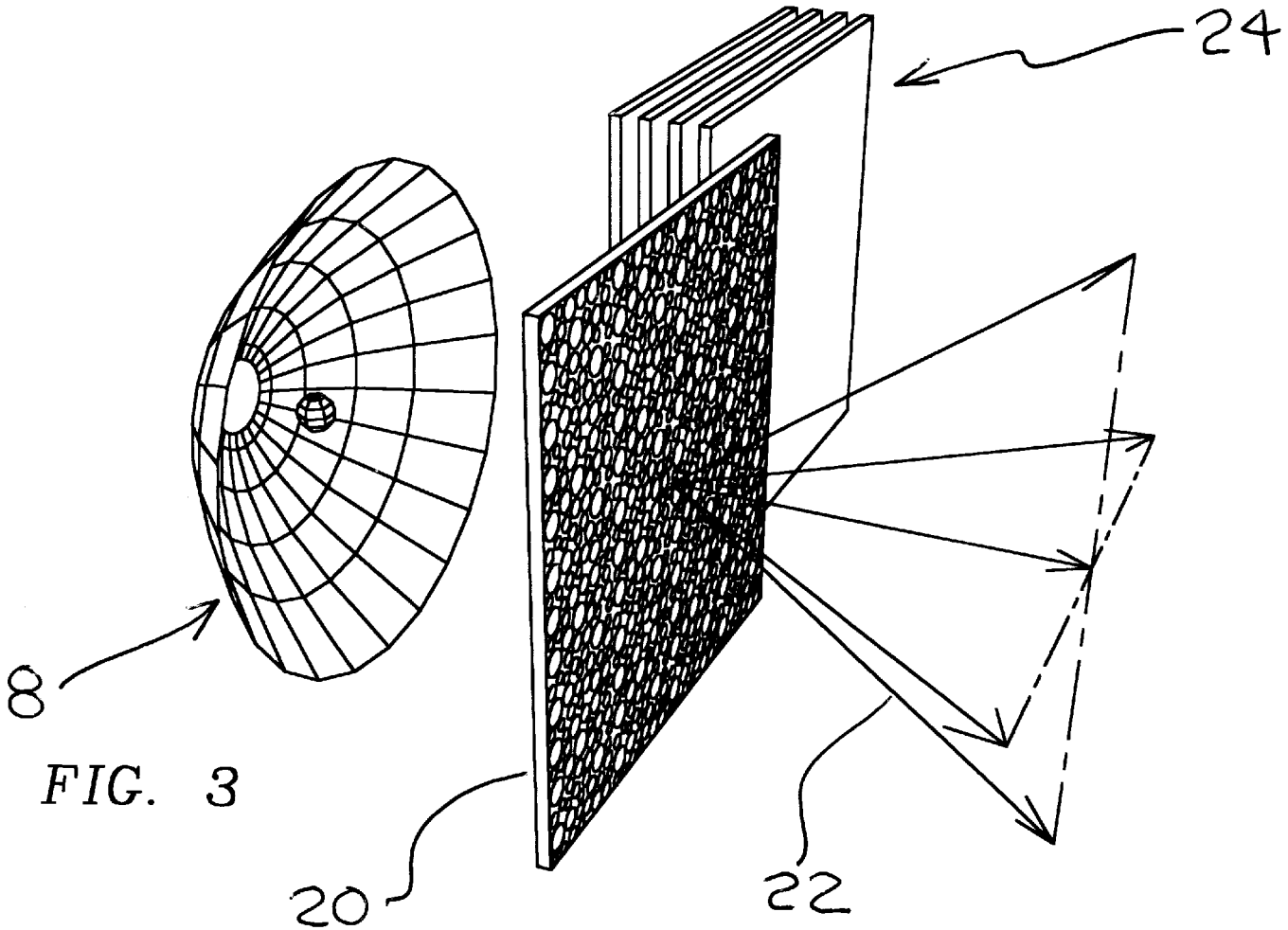
FIG. 3 shows a perspective view showing the light rays emanating in all directions from the filter assembly.

Referring now to FIG. 3, the system diffusion optical element 20 is again shown diffusing the projected outbound light 22. The system diffusion optical element 20 diffuses the light in all directions around a centerline of a light path as is illustrated. The optical element 20 can be made from many materials and in many configurations to diffuse the light in different ways. Glass or plastic with a textured surface are two examples of acceptable materials for the system diffusion optical element 20. The system diffusion optical element 20 may be fabricated from many materials and configurations, and the fabrication processes required to form the system diffusion optical element 20 are well known to persons skilled in the art.

Figure 4:
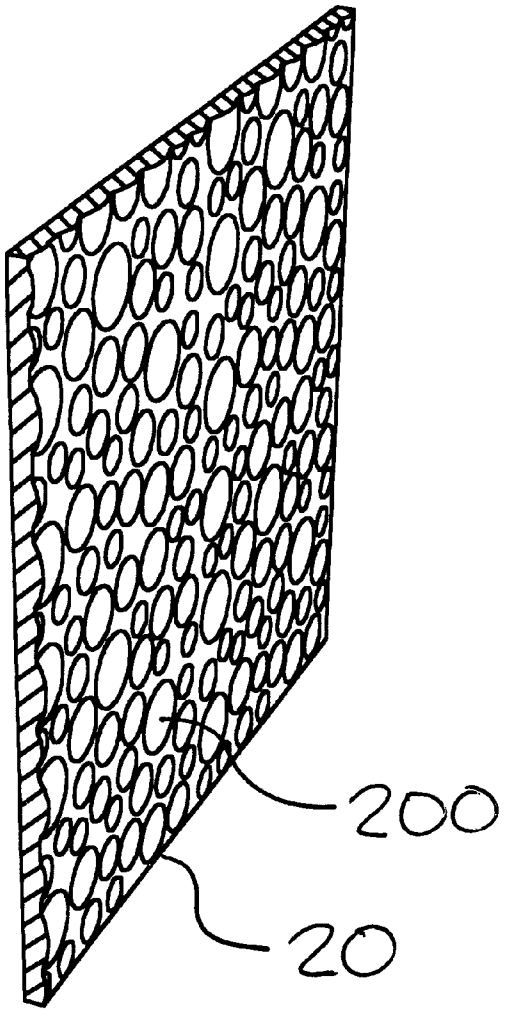
FIG. 4 is a sectional perspective view of a quadrant of the system diffusion filter.

FIG. 4 shows a perspective sectional view of one embodiment of the system diffusion optical element 20. In this view it can be readily observed that the system diffusion optical element 20 comprises a large plurality of discrete individual refractive elements 200. The individual refractive elements 200 of the system diffusion optical element 20 bend the light beam in all directions to create a homogenous projected light beam. The size, shape, slope, and placement pattern of the individual refractive elements 200 can be of nearly unlimited variations, each affecting to a degree the nature of the projected light. One functional limitation is that the size of the individual refractive elements 200 must not be too large, or the projected light beam will take on a grainy quality.

Figure 5:
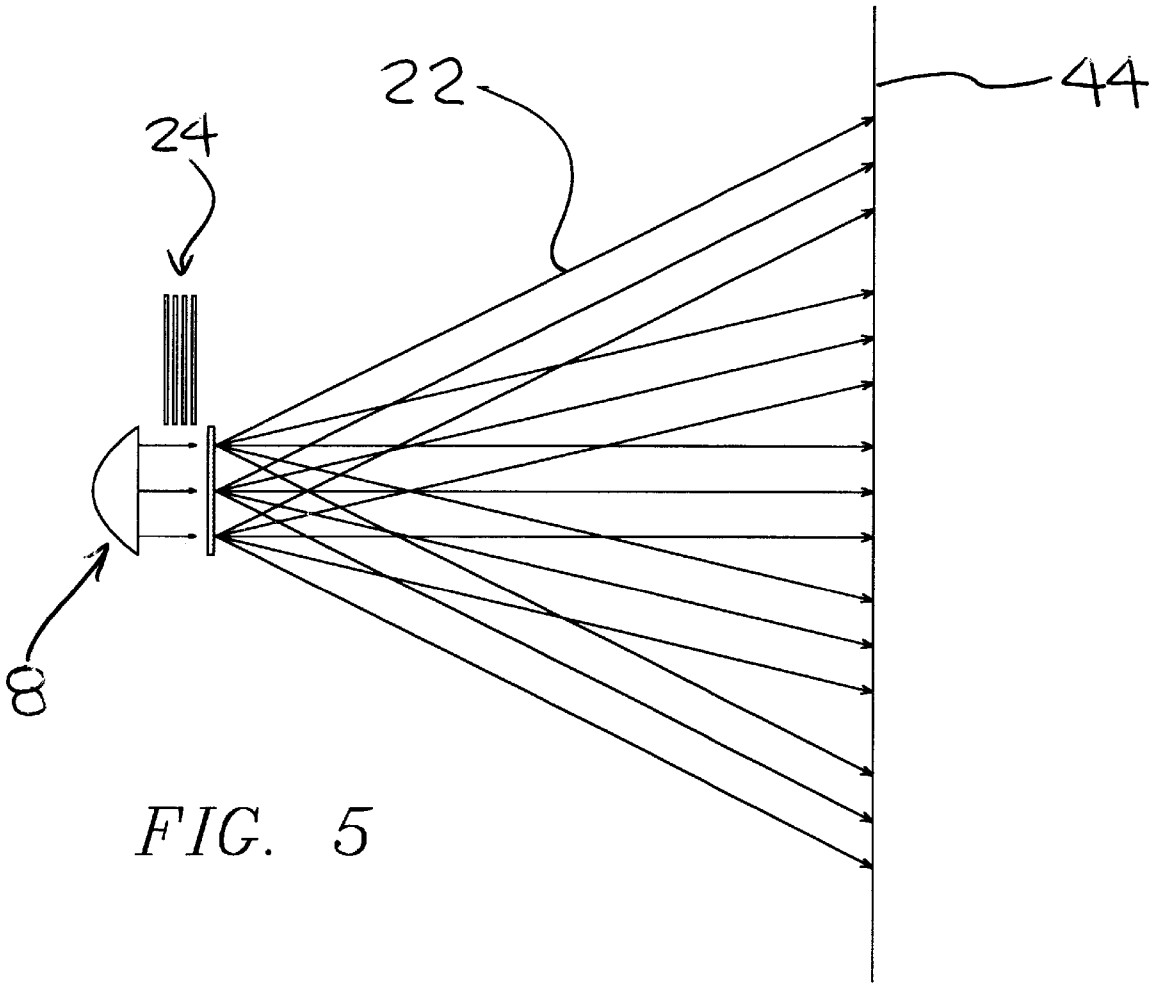
FIG. 5 shows a side view of the light distribution as projected on a surface perpendicular to the longitudinal axis of the optical path.

Referring now to FIG. 5, the outbound light rays 22 are shown as being projected on a flat surface 44. The flat surface 44 is orthogonal to the longitudinal axis of the projected beam 22. The light distribution on this surface is smooth, and the intensity of the light drops off evenly as a function of distance from a center point of the projected beam 22 on the flat surface 44. The characteristics of the light distribution on the surface are a result of the diffusion parameters of the optical elements in the module.

Figure 6:
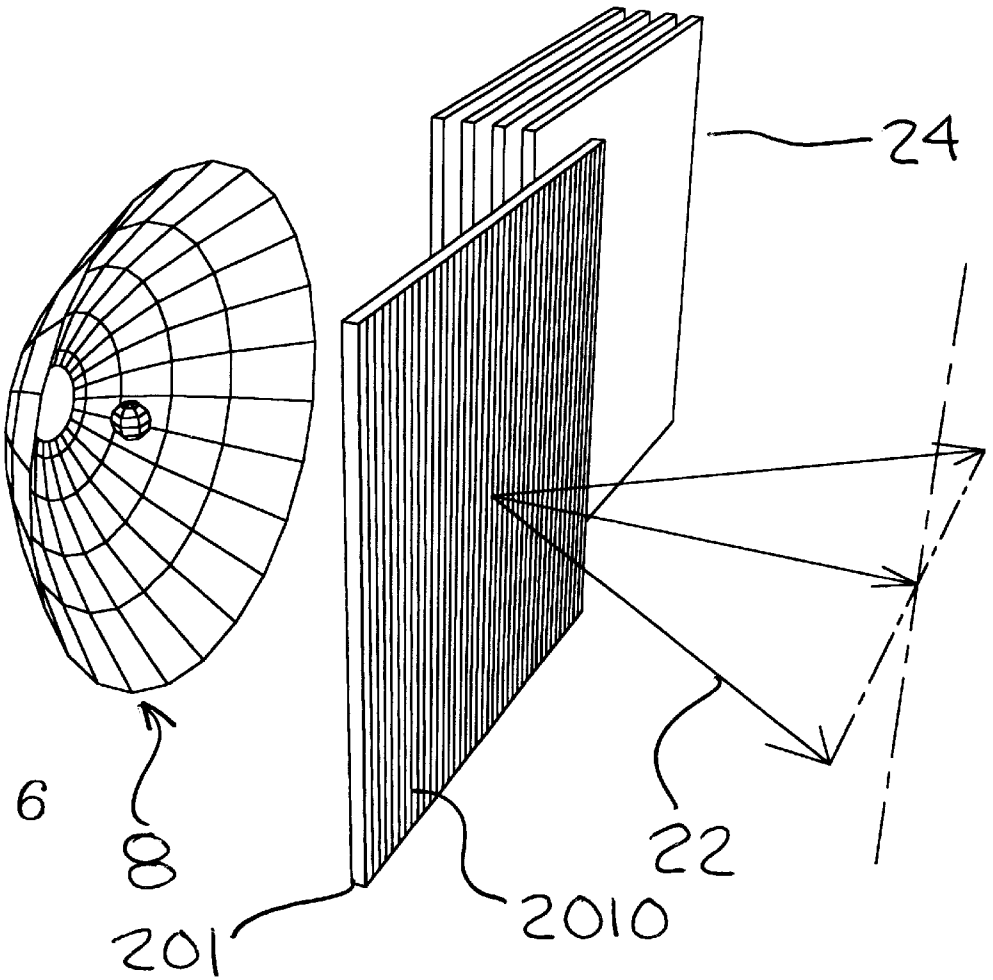
FIG. 6 shows a perspective view of the device with light rays emanating from the system diffusion filter in primarily one direction.
Figure 7:
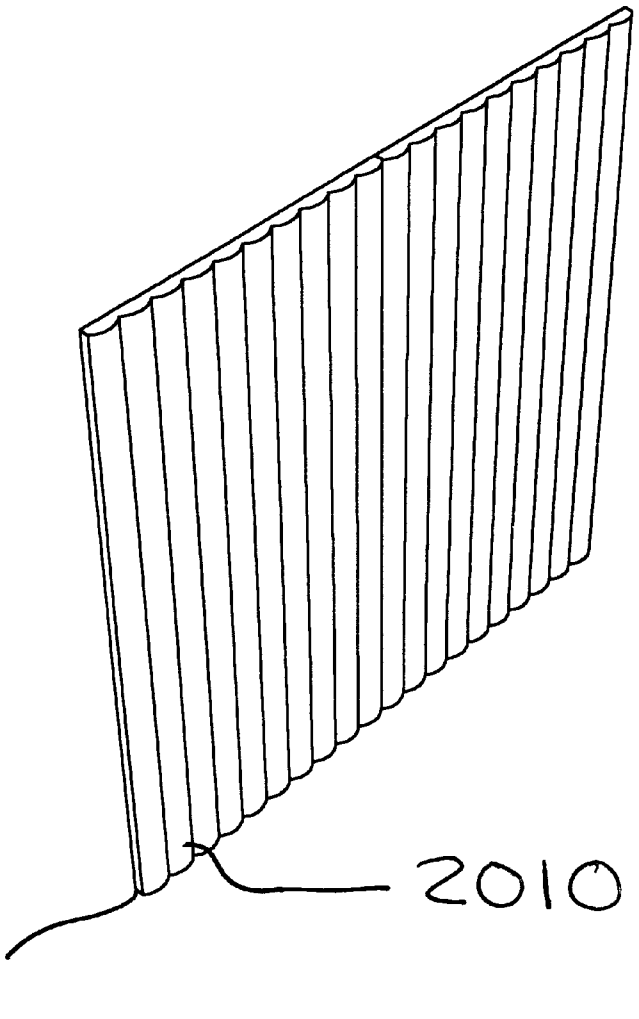
FIG. 7 shows a perspective view of the unidirectional filter utilized in FIG. 6.

In some applications, it is desirable to have the light diffused in a single direction. In the module configuration shown in FIG. 6, the light is diffused only in the horizontal direction and remains generally parallel in other directions. FIG. 7 shows a unidirectional optical element 201 that would be used to diffuse the light in only a horizontal direction as shown in FIG. 6. The unidirectional optical element 201 comprises a plurality of refractive elements 2010 that each extend across the width of the unidirectional optical element 201. For the horizontal diffusion pattern that is illustrated, the refractive elements 2010 would be aligned vertically across the optical element. For a vertical diffraction of the light, the elements would be horizontal. The structure of the refractive elements 2010 for the unidirectional system diffusion optical element 201 illustrated in FIGS. 6 and 7 is to be contrasted with the refractive elements 200 of the all-directional diffusion of the system diffusion optical element 20 depicted in FIG. 4.

While the uni-directional refractive elements 2010 are shown as continuous elements that span the width of the system diffusion optical element 201, it should be recognized that there could just as easily be a plurality of the refractive elements 2010 across the width of the diffusion optical element 201. It should also be recognized that one skilled in the art could adjust the conformation of the individual refractive elements to provide any degree of directional diffusion. That is, all levels of diffusion between and including the all-directional diffusion of the system diffusion optical element 20 to the unidirectional diffusion of the system diffusion optical element 201 are easily achieved by modifying the conformation of the system optical diffusion element.

Figure 8:
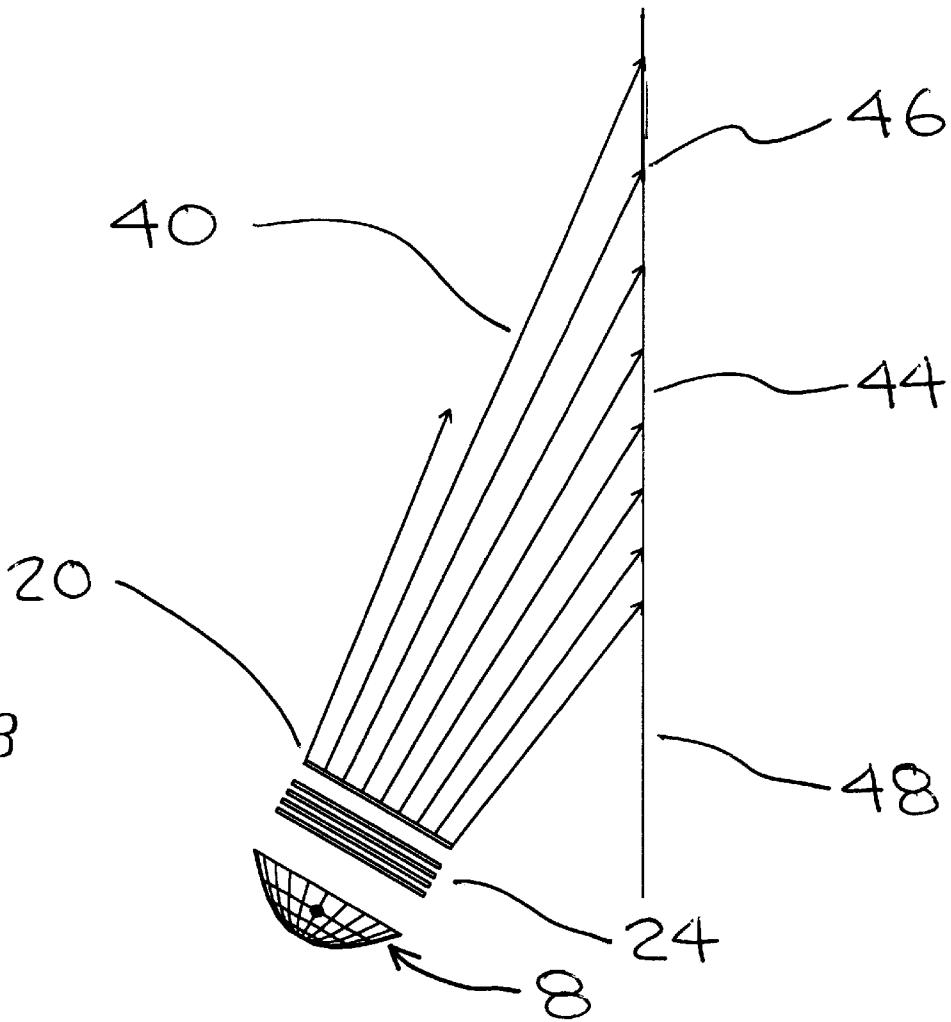
FIG. 8 shows a side view of the light distribution from the module as projected on a surface off axis to the light beam.
Figure 9:
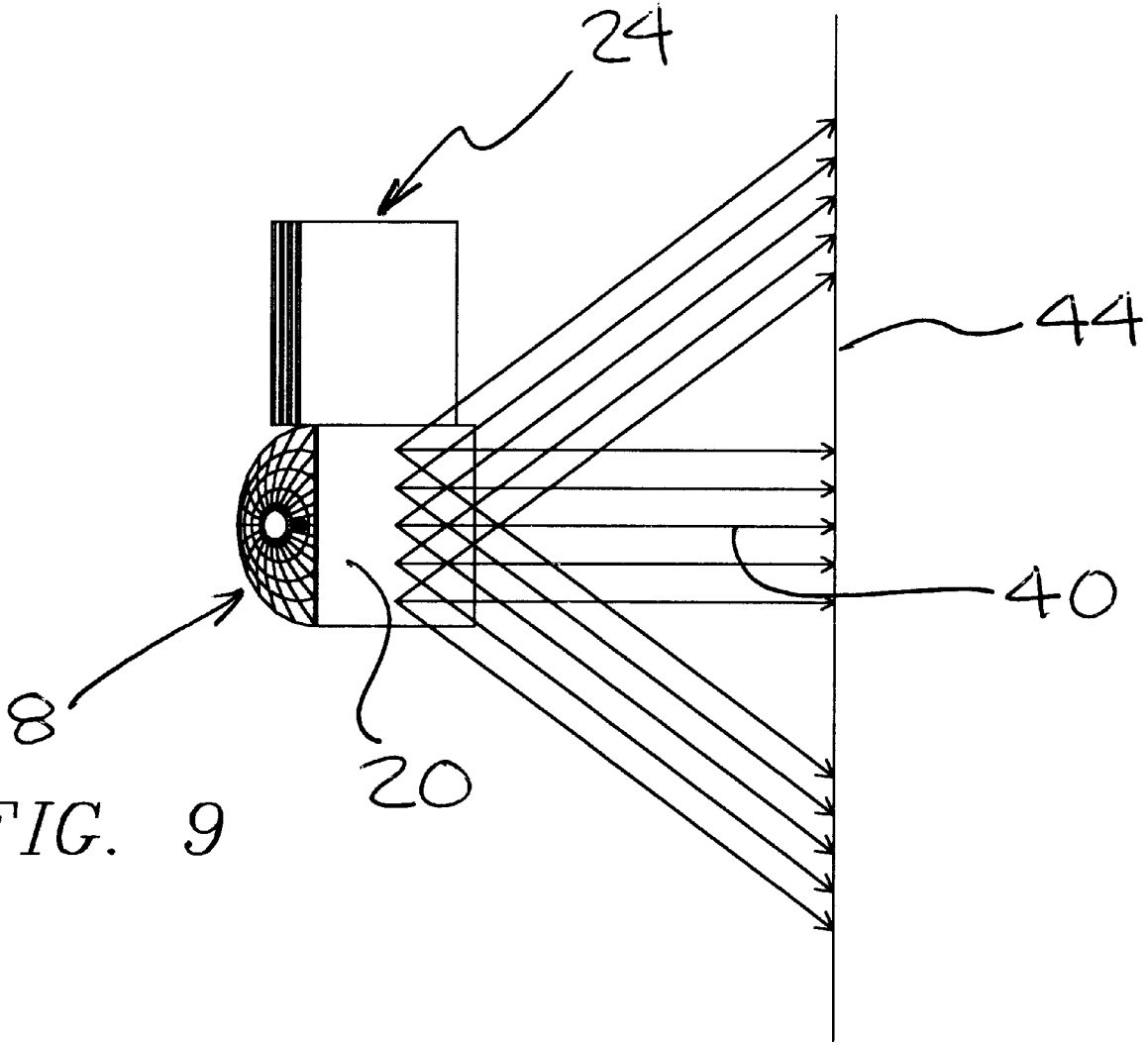
FIG. 9 is a top view of the configuration shown in FIG. 8.

Referring now to FIG. 8, the projected light 40 is shown projected on a flat surface, a wall 44. The flat surface 44 is off axis (i.e. non-perpendicular) to the longitudinal axis of the projected beam 22. The quantity of light projected to the upper portion 46 of the wall is much greater than that projected to the lower surface 48. However, because the upper portion 46 is a greater distance from the light source, the overall intensity of the light on the wall 44 remains generally uniform. FIG. 9 is a top view of the configuration shown in FIG. 8, showing the light projected transversely. By diffusing the light in only one direction, more of the light can be delivered to the target, (the upper portion 46 of the wall 44), while providing a broad distribution of light along the transverse direction. In practice, multiple light systems would be used for a given lighting scheme.

In a configuration in which the light is diffused in only one direction, one requirement for the operation of the filter assembly 24 in the module is that the color filters must enter the light beam from substantially the same direction as the direction of diffusion.

OPERATION OF THE INVENTION

Figure 10:
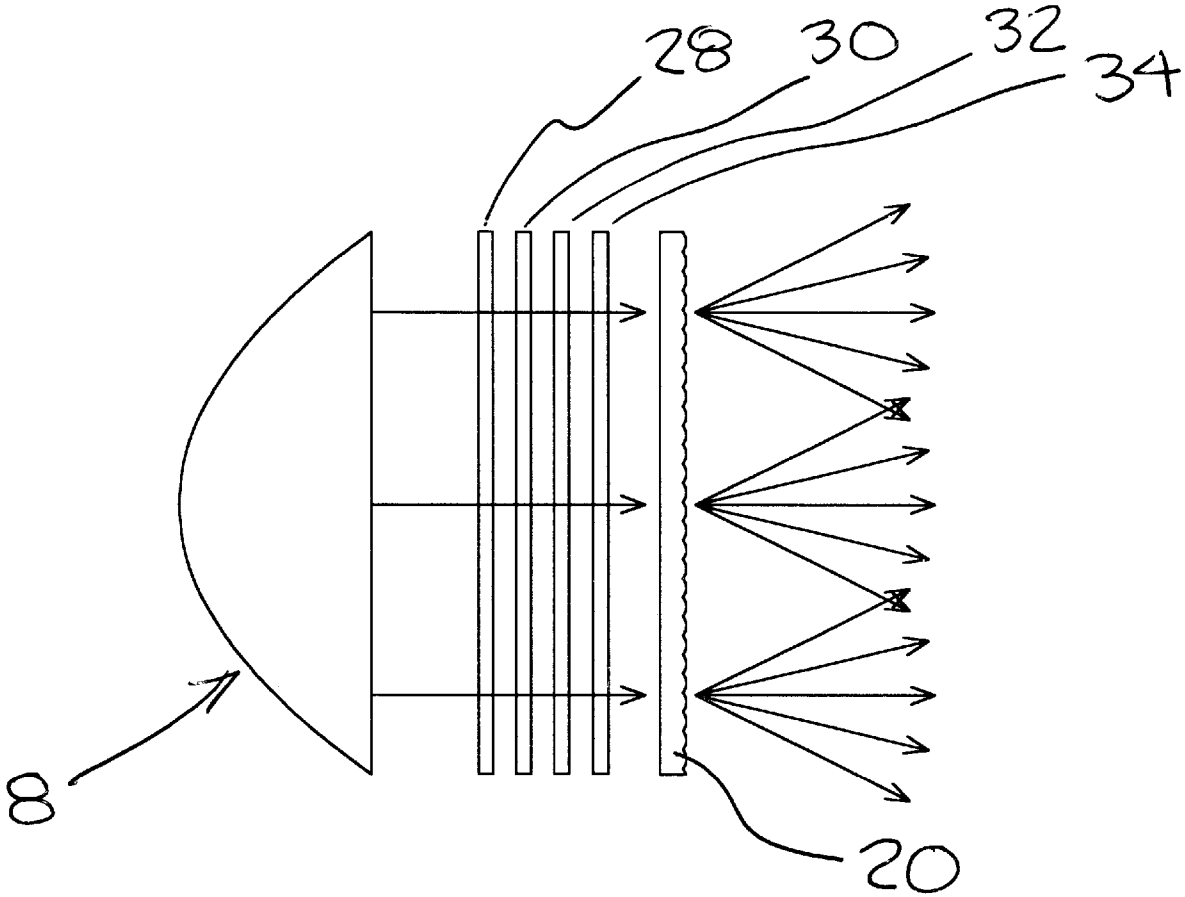
FIG. 10 shows a top view of the module with the filters deployed.

In FIGS. 3 and 6, the filters 28, 30, and 32 of the filter assembly 24 are shown in the non-deployed position. FIG. 10 shows the filters 28, 30, and 32 in the deployed position. In order to produce red, green, or blue projected light, at least two of the filter elements 28, 30, and 32 are deployed simultaneously. Partial deployment of one or more of the filters 28, 30, and 32 creates different hues and/or saturation of colors. By altering combinations of the three filters 28, 30, and 32 any saturation, hue, or intensity of color can be created by the user. Deploying size diffusion filter 34 allows the user to increase the diffusion of the projected light beam.

Figure 11:
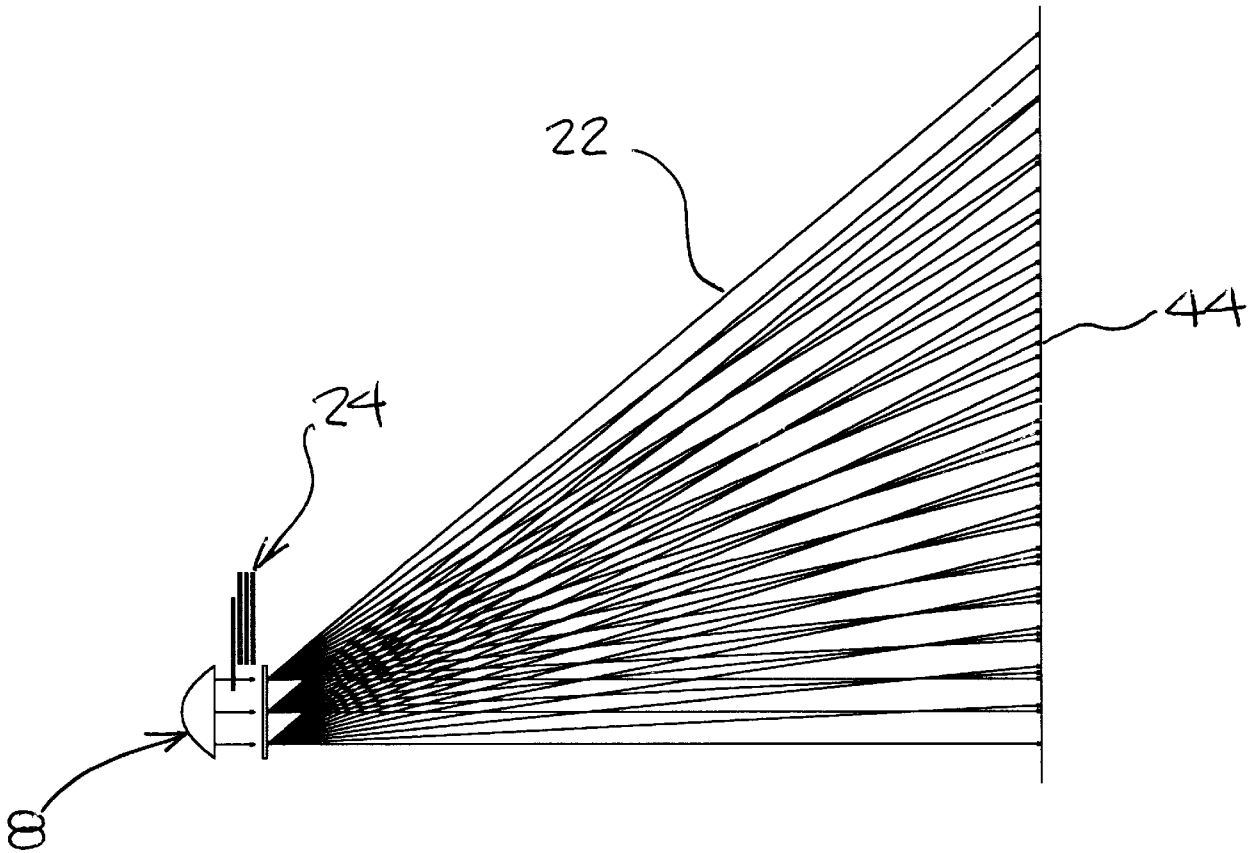
FIG. 11 illustrates a situation in which a yellow filter is partially deployed in the light beam, with only a portion of the light beam being illustrated.

FIG. 11 illustrates how even a partial deployment of one of the filters of the filter assembly results in an even color distribution of outbound light. Although the yellow filter 32 (yellow filter 32 being used only as an example, the same analysis is true for all color filters) is only introduced into a small segment of the light beam, the resultant outbound light beam is entirely an even color due to the diffusion of the light by the system diffusion optical element 20. The system diffusion optical element 20 is shown to be after the filter assembly 24 in order in the light path. However, the system diffusion optical element 20 could also be placed immediately before the filter assembly 24, and the module would still yield the same resultant projected light.

Because the system diffusion optical element 20 evenly spreads the light provided by the light source, a smaller number of modules (as compared with the number of prior art devices that would be required) is necessary to-light a given area.

The movement of the filters 28, 30, 32, and 34 into and out of the interchangeable filter region can be done manually, or it can be accomplished by a motor or solenoid utilizing remote or computer control. An individual knowledgeable in the art of motor or solenoid control could devise numerous ways to control the deployment of the filters 28, 30, 32, and 34. The size diffusion filter 34 of the filter assembly 24 is deployed if the user desires to increase the size of the outbound light beam 22.

The above disclosure is not intended as limiting. Those skilled in the art will readily observe that numerous modifications and alterations of the device may be made while retaining the teachings of the invention. Accordingly, the above disclosure should be construed as limited only by the restrictions of the appended claims.

I claim:

1. A module that produces a beam of projected light comprising:

a light source that generates generally parallel light, and a system diffusion optical element; wherein said system diffusion optical element comprises a plurality of discrete individual refractive elements projecting from a surface of said system diffusion optical element, said refractive elements being non-continuous along any axis of said system diffusion optical element such that said individual refractive elements bend a source light beam generated by said light source in all directions around a centerline of a light path to create a homogeneously diffused projected light beam, and at least one filter element is provided in said module, said filter element being positioned so that it can be selectively introduced into a path of said source light beam, and when said at least one filter element is introduced to any part of said path of said source light beam, a quality produced by said filter element is imbued to the entire said projected light beam.

2. The module that produces a beam of projected light of claim 1 wherein:

a filter assembly comprising a plurality of filter elements is positioned in said module such that said filter elements may be selectively introduced into a path of said source light beam individually or in combination.

3. The module that produces a beam of projected light of claim 2 wherein:

when any of said filter elements are introduced to any part of said path of said source light beam, a quality produced by said filter elements is imbued to an entire said projected light beam.

4. The module that produces a beam of projected light of claim 1 wherein:

said system diffusion optical element is behind said at least one filter element in a path of said source light beam.

5. The module that produces a beam of projected light of claim 1 wherein:

said system diffusion optical element is in front of said at least one filter element in a path of said source light beam.

6. A module that produces a beam of projected light comprising:

a light source that generates generally parallel light, and a system diffusion optical element; wherein said system diffusion optical element comprises a plurality of individual refractive elements projecting from a surface of said system diffusion optical element, said individual refractive elements being elongated in a single axis direction such that said individual refractive elements bend a source light beam generated by said light source chiefly in a direction orthogonal to said single axis direction of said individual refractive elements, a remainder of said source light beam remaining generally parallel, so as to create a projected light beam that is homogeneously diffused in said one direction, and at least one filter element is provided in said module, said filter element being positioned so that it can be selectively introduced into said source light beam in an orientation substantially orthogonal to a path of said source light beam, and when said at least one filter element is introduced to any part of said path of said source light beam, a quality produced by said filter element is imbued to the entire said projected light beam.

7. The module that produces a beam of projected light of claim 6 wherein:

a filter assembly comprising a plurality of filter elements is positioned in said module such that said filter elements may be selectively introduced in a substantially orthogonal orientation into a path of said source light beam individually or in combination.

8. The module that produces a beam of projected light of claim 7 wherein:

when any of said filter elements are introduced to any part of said path of said source light beam, a quality produced by said filter elements is imbued to an entire said projected light beam.

9. The module that produces a beam of projected light of claim 6 wherein:

said system diffusion optical element is behind said at least one filter element in a path of said source light beam.

10. The module that produces a beam of projected light of claim 6 wherein:

said system diffusion optical element is in front of said at least one filter element in a path of said source light beam.

11. A module that produces a beam of projected light comprising:

a light source that generates generally parallel light, and a system diffusion optical element; wherein said system diffusion optical element comprises a plurality of discrete individual refractive elements projecting from a surface of said system diffusion optical element, said refractive elements being non-continuous along any given axis of said system diffusion optical element such that said individual refractive elements bend a source light beam generated by said light source in more than one direction around a centerline of a light path to create a homogeneously diffused projected light beam, and at least one filter element is provided in said module, said filter element being positioned so that it can be selectively introduced into a path of said source light beam, and when said at least one filter element is introduced to any part of said path of said source light beam, a quality produced by said filter element is imbued to the entire said projected light beam.

12. The module that produces a beam of projected light of claim 11 wherein:

a filter assembly comprising a plurality of filter elements is positioned in said module such that said filter elements may be selectively introduced into a path of said source light beam individually or in combination.

13. The module that produces a beam of projected light of claim 12 wherein:

when any of said filter elements are introduced to any part of said path of said source light beam, a quality produced by said filter elements is imbued to an entire said projected light beam.

14. The module that produces a beam of projected light of claim 11 wherein:

said system diffusion optical element is behind said at least one filter element in a path of said source light beam.

15. The module that produces a beam of projected light of claim 11 wherein:

said system diffusion optical element is in front of said at least one filter element in a path of said source light beam.

* * * * *